United States Patent [19]

Talbot

[11] 4,403,495

[45] Sep. 13, 1983

[54] APPARATUS FOR BENDING CHANNEL SECTION MEMBERS

[75] Inventor: Terence R. Talbot, Newport, England

[73] Assignee: Rockwell International Corporation, Pittsburgh, Pa.

[21] Appl. No.: 263,817

[22] Filed: May 15, 1981

[51] Int. Cl.[3] ..... B21D 7/03

[52] U.S. Cl. ..... 72/383; 72/411

[58] Field of Search ..... 72/411, 383, 386, 389, 72/380, 353, 301

[56] References Cited

U.S. PATENT DOCUMENTS

| | | | |
|---|---|---|---|
| 251,003 | 12/1881 | Vanstone | 72/389 |
| 2,947,344 | 8/1960 | Springer | 72/411 |
| 3,159,198 | 12/1964 | Sutch | 73/383 |
| 3,501,941 | 3/1970 | Long | 72/411 |
| 3,898,832 | 8/1975 | Eckold | 72/389 |

FOREIGN PATENT DOCUMENTS

| | | | |
|---|---|---|---|
| 938664 | 2/1956 | Fed. Rep. of Germany | 72/389 |

*Primary Examiner*—Gene Crosby

[57] ABSTRACT

An apparatus for bending an elongate member with a pair of spaced parallel planar flanges which normally extend from the planar web to form a channel section. The apparatus includes a platen shaped for close fitting engagement with the exterior web and flange faces of the elongate member in a region where the elongate member is bent. The platen also includes a counter-pressure member, one surface of which engages the exterior face of the web of the elongate member in the bending region. The counter-pressure member is capable of being selectively advanced or retracted within the platen. A movable head member shaped for close fitting engagement with the interior web and flange faces of the elongate member in the bending region has projections which apply a force in the bending region acting in the planes of the flanges on longitudinally spaced portions of the elongate member for relative displacement of the portions. During this displacement, the projection is maintained in a close fitting engagement with the interior web and flange faces of the elongate member while the platen and the counter-pressure member are maintained in a closely fitting engagement with the exterior web and flange faces of the elongate member so that the flanges in the bending region of the elongate member are maintained in a planar position.

2 Claims, 5 Drawing Figures

APPARATUS FOR BENDING CHANNEL SECTION MEMBERS

This invention relates to the bending of channel section members, for example in the manufacture of vehicle chassis frames or other fabricated structures using sheet or plate metal members.

It is often required to form a bend or bends in a channel section lying in the plane of the flanges of the channel i.e. involving deformation of the flanges about an axis or axes normal to their planes. This involves stretching or compression of the flange material longitudinally of the member particularly in those parts of the flange which will form the maximum radius parts of the finished bend. Specifications of metal used may vary so that behaviour of the material is, to some extent, unproductable. These problems have caused difficulty in bending channel sections satisfactorily as regards finished appearance and maintaining consistent dimensions. In particular bending has often resulted in unsightly and possibly weakening ripples or crinkling of areas of the flanges in the regions of the bend or bends.

The object of the invention is to provide a method of and apparatus for bending channel section members which permits close control of the bending process and improved and consistent results, giving a finished workpiece which is of neat and uniform appearance and precisely dimensioned.

According to the invention there is provided apparatus for bending an elongate member comprising a pair of spaced parallel planar flanges extending normally from a planar web to form a channel section, said apparatus comprising interacting formations which are shaped for and movable into close fitting engagement with the interior and exterior faces of each flange at least in a region of the member in which a bend is to be effected, said formations being articulated for movement of at least a first section relative to a second section to apply a bending force acting in the planes of the flanges to longitudinally spaced portions of the member for relative displacement thereof to form at least one bend, said close fitting engagement of the flange faces being maintained during said displacement to ensure that the flanges in said region of the member remain planar.

The invention further resides in a method of forming a bend or bends in a channel section member by taking the steps of the process carried out by the apparatus above defined, and in a member processed, i.e. bent, using said apparatus and/or method.

Said bending may be simple, i.e. a single bend so that a first portion of the member is bent at an angle to a second portion, or compound i.e. forming more than one bend so that a first portion is angled or laterally offset with respect to another portion or portions e.g. cranked or joggled, the offset being along a plane parallel to one or more of the remaining portions.

Thus in forming a joggle in which a centre straight portion of the member is to be laterally offset with respect to two end portions, the latter being on a common axis, a total of four bends (two pairs in opposite directions) will be necessary and the apparatus may be adapted to form all these bends in a single step while maintaining the flanges planar in all the bend regions.

The apparatus may further include provision for overbending to allow for spring back of portions of the material after the workpiece is released following bending.

One practical embodiment of the invention is now more particularly described with reference to the accompanying drawings wherein.

The example of the invention now to be described relates to the forming of side members of vehicle chassis frames, said members being pressed from heavy gauge metal sheet or plate to a channel cross section having a pair of spaced parallel flanges which are generally horizontal in the assembled chassis and a vertical web between and normal to the flanges.

Figure 3:
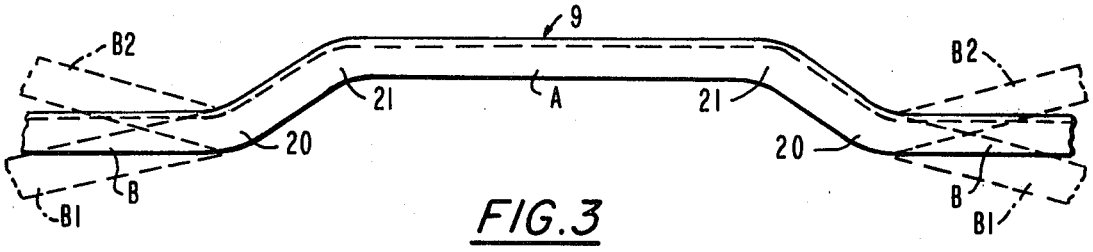
FIG. 3 is a diagram of a workpiece.

In the present example the member 9 is required to be finished to the shape indicated diagrammatically by the full lines of FIG. 3 to include a double cranking or joggle so that a straight intermediate portion A is laterally offset with respect to straight end portions B.

A straight channel section is first formed by conventional processes and is then bent to the final form by the method and in the apparatus now to be described.

Figure 1:
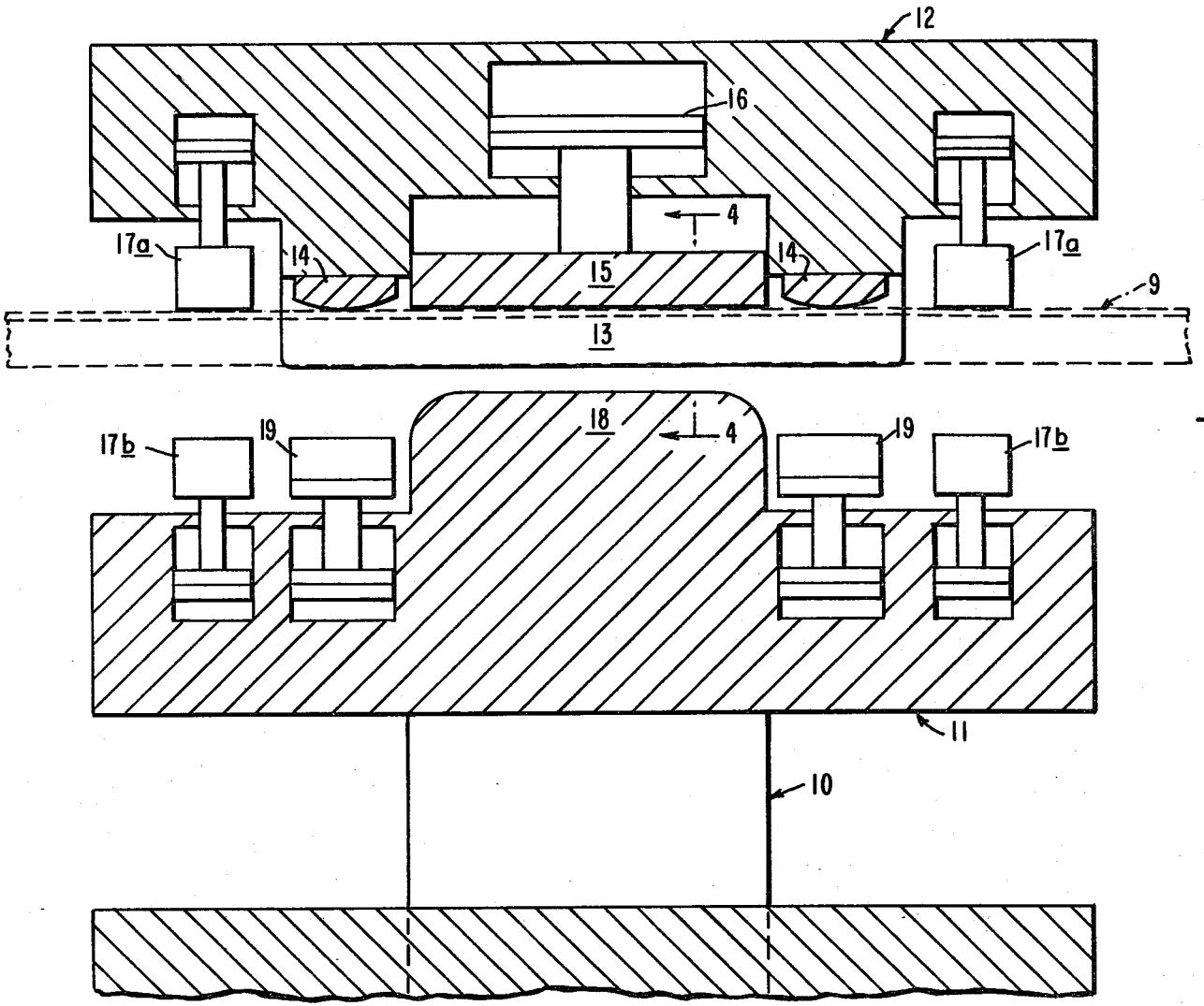
FIG. 1 is a sectional plan view of operative parts of a bending press at the commencement of an operating cycle.
Figure 2:
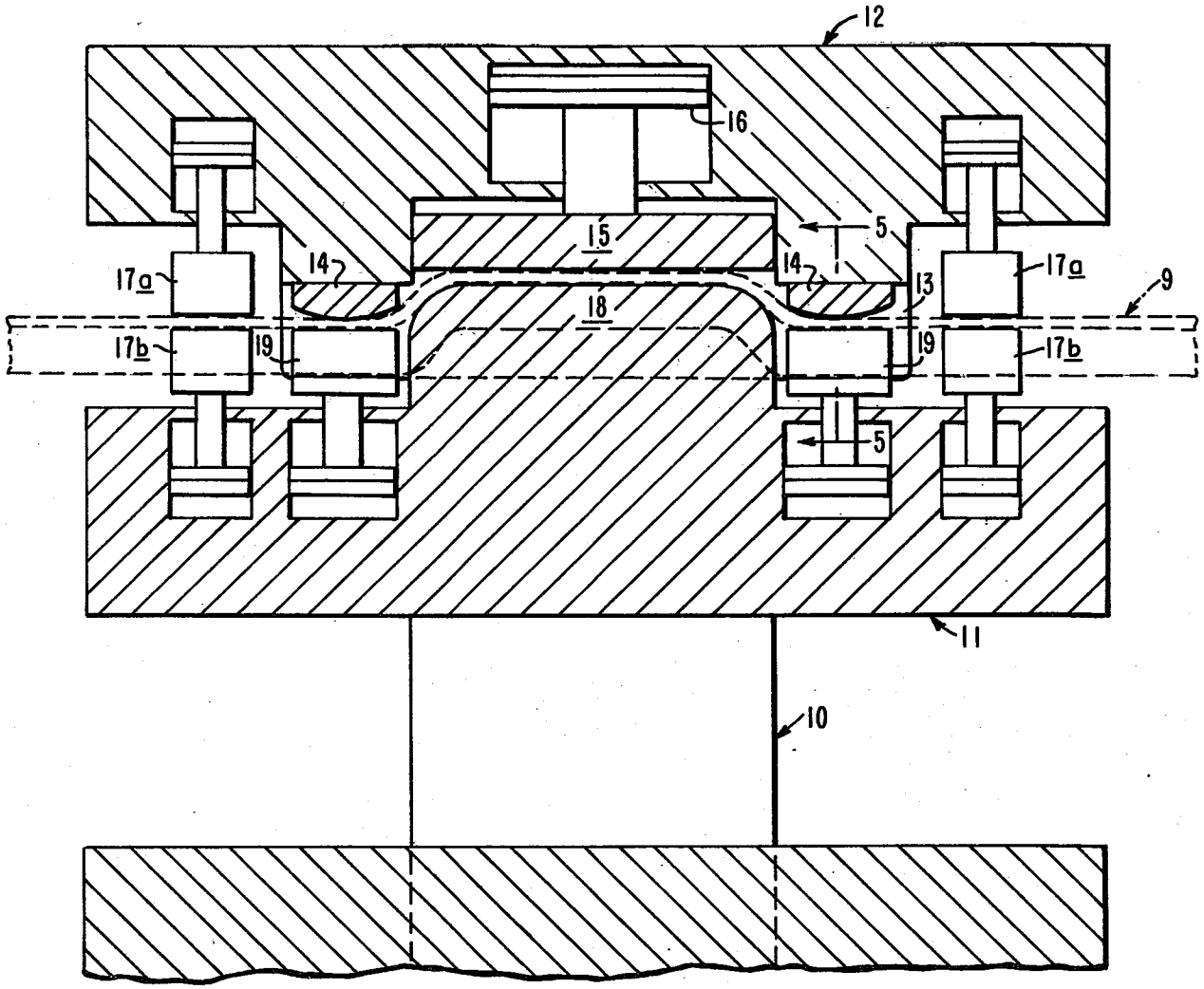
FIG. 2 is a like view of the press with the parts in the coacting position of the bending process.

Referring to FIGS. 1 and 2 the apparatus is based on a standard 400 ton horizontal hydraulic press comprising a main ram 10 carrying a main ram head 11 which coacts with a fixed platen 12 of the press.

Figure 4:
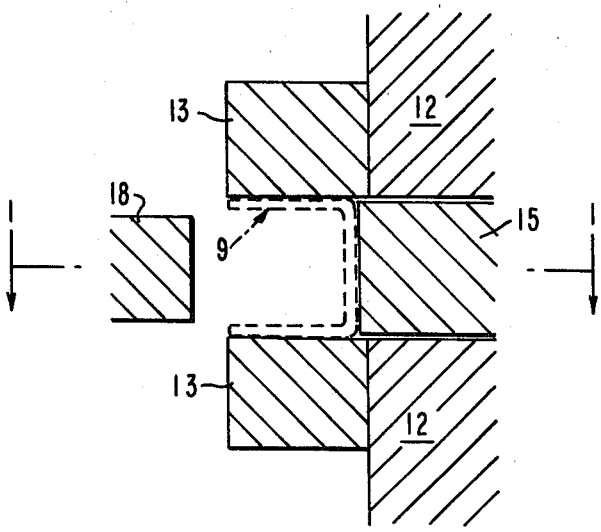
FIG. 4 is a section on line 4—4 of FIG. 1.

As best seen in FIG. 1 and 4, central portion of platen 12 has upper and lower parallel spaced guide blocks 13 defining a channel open towards head 11 and extending laterally of the press, said channel having a width which closely fits the outer faces of the flanges of member 9.

Opposite end portions of said channel have respective fixed bolsters 14 mounted therein, outer faces of said bolsters being convex in plan longitudinally of the channel.

Between bolsters 14 the rear wall of said channel is cut away to contain a movable longitudinal counter-pressure member 15 which can be selectively advanced or retracted by means of a hydraulic counter pressure ram 16 within platen 12.

Parts of platen 12 lying laterally beyond guide members 13 each include a respective hydraulic overbending ram 17*a* whose heads can be advanced or retracted in conjunction with corresponding overbending rams 17*b* carried on the main ram head 11.

Head 11 incorporates a central projection 18 extending longitudinally and having a planar forward face whose length corresponds substantially with the length of counter-pressure member 15 terminating in curved end faces.

Projection 18 will enter the channel between members 13 when head 11 is advanced and the vertical depth of the projection is such that it is a close fit between the flanges of the member.

Also carried on main head 11 is a pair of locating rams 19 having heads which can be selectively advanced or retracted relative to main head 11 in coacting relationship with bolsters 14 of platen 12, said heads also being a close fit between the member flanges.

Figure 5:
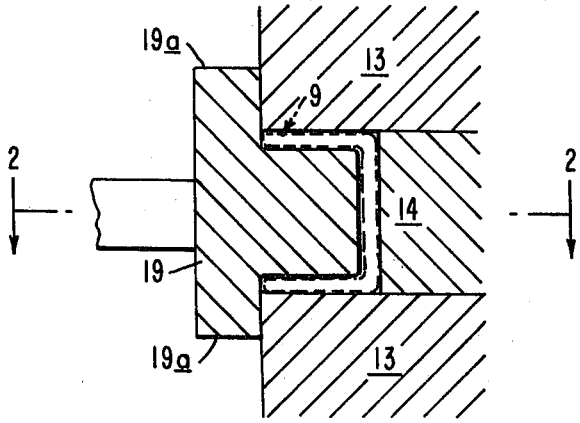
FIG. 5 is a section on line 5—5 of FIG. 2.

The acting parts of the heads of rams 19 extend forwardly of vertically projecting lips 19*a* (see FIG. 5) which abut the outer faces of members 13 to define a fixed clearance between the end face of the ram head and the face of the corresponding bolster 14, said clearance closely accommodating the thickness of the web of member 9.

The operation of the press is as follows.

A straight length of member (which may be of uniform or non-uniform section throughout its length, e.g., the depth and/or spacing of the flanges may change along the length or in regions thereof) is located in the channel between members 13 in the position indicated by broken lines in FIG. 1 and with counter-pressure member 15 advanced in line with the foremost parts of the curved faces of bolsters 14 so that the web is backed by these.

Main head 11 is advanced so that projection 18 enters between the flanges until it is pressing a centre portion of the web against counter-pressure member 15, back pressure being applied to ram 16 to tightly engage said portion of the web and keep it flat while main head 11 continues its advance.

At the same time the acting parts of the heads of locating rams 19 are also entered between the flanges, these rams being pressurised so that lips 19*a* are maintained in abutment with the outer faces of guide members 13 as referred to above. This maintains the flanges and web in alignment but permits the end portions B to slide longitudinally to the extent necessary to provide the shorter overall length needed to form the offset or joggle.

In this position (as shown in FIG. 2) the central portion of the member which is to be subjected to the double bending and, in particular, its flanges, are closely confined in all directions by the coacting faces of the platen and main head assemblies including the guide members 13, the projection 18, and the heads of locating rams 19 so that no part of them can be displaced upwardly or downwardly out of their general parallel planes. This confined condition is maintained throughout advance of the main ram head 11 to displace the centremost region of member 9 laterally against the counter-pressure exerted by member 15 to the extent necessary to create the desired double bending or joggle thus no crinkling or rippling of the member flanges can take place in the regions of the four bends necessary to create this shape.

The extent of displacement of the centre section can be selectively adjusted to allow for "spring-back" so that the final shape, when released from the press, is within required tolerances even though the specification of the metal, in particular its yield strength, may vary.

The effect of the above bending process will tend to stress the material so that, when released from the press, the outer end portions B will spring toward the positions indicated by broken lines at B1 in FIG. 3.

In-built correction for this is provided by selective operation of the overbending rams 17*a*, 17*b* to apply or maintain pressure on end portions B during the press operation to deflect them sufficiently to compensate for this "spring-back" e.g. to displace them toward the position shown by dotted lines B2 or to compensate for any over-correction applied.

The operation of the invention provides a cranked or joggled channel section chassis side or other member to extremely close and consistent tolerances of high strength and durability and of good appearance. In particular the avoidance of crinkling or waves in the flanges at the bend regions considerably enhances the appearance, facilitates subsequent assembly as planar upper and lower faces are maintained for accurate mounting of components etc, and may improve the strength and resistance to flexure of the finished member.

The confining of the flanges in the way above described, particularly in the bend regions, ensures that displacement of the flange material which has to take place in forming the bends can only be outwards or inwards relative to the web, i.e. in the case of the rearward bends indicated at 20 on FIG. 3 the web forms the smallest radius side of the bend and the flange has to be somewhat stretched longitudinally, the invention ensuring that its width is correspondingly reduced in a uniformly graduated manner without substantially affecting the finished appearance. In the forward bend indicated at 21 where the web is at the greatest radius portion the flange has to be compressed and is thus particularly susceptible to crinkling or rippling using known processes, use of the present invention ensures that the metal is displaced laterally so that it becomes somewhat wider in a uniformly graduated manner at this region but remains truly planar.

The invention may have application to other bending or possibly straightening processes effected on channel sections where cranking, joggling or single or double bends have to be provided in the planes of the flanges. Thus for some applications only a single locating ram and corresponding bolster may be needed with projection 18 or its equivalent and its counter-pressure means operating to form a single bend, the shaping of these elements being according to the degree of curvature and angles required in the finished article. For some applications the provision for compensation in respect of "spring-back" may be unnecessary and the overbending rams 17*a*, 17*b* may be dispensed with.

It is also to be appreciated that the invention could be based on other forms of press or bending tool, for example vertical presses and/or screw operated presses.

I claim:

1. An apparatus for bending an elongate member comprising a pair of spaced parallel planar flanges extending normally from a planar web to form a channel section, said apparatus including a first means for close fitting engagement with the exterior web and flange faces of said elongate member at least in a region of said elongate member in which a bend is to be formed, said first means further having a counter-pressure means, one surface of which engages the exterior face of said web of said elongate member in said bending region, said counter-pressure means capable of being selectively advanced or retracted within said first means; a second means shaped for close fitting engagement with the interior web and flange faces of said elongate member at least in said bending region of said elongate member, said second means being articulated for movement of projection means on said second means, said movement being relative to said first means to apply a bending force in said bending region acting in the planes of said flanges on longitudinally spaced first and second portions of said elongate member for relative displacement thereof informing at least one bend, said second means and projection means being maintained in a close fitting engagement with said interior web and flange faces of said elongate member during said displacement, and said first means and said counter-pressure means being maintained in a closely fitting engagement with said corresponding exterior web and flange faces of said elongate member during said displacement, whereby said flanges in said region of said member are maintained in a planar position.

2. An apparatus for bending an elongate member as set forth in claim 1, wherein said first portion of said elongate member is bent at an angle to a third portion of said elongate member forming more than one bend whereby said first portion is offset with respect to said third portion of said elongate member, said offset being along a plane parallel to said third portion of said elongate member.

* * * * *